US006443740B1

(12) United States Patent
Evans

(10) Patent No.: US 6,443,740 B1
(45) Date of Patent: Sep. 3, 2002

(54) CONNECTOR SYSTEM

(75) Inventor: Robert F. Evans, Bedford, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/529,542

(22) PCT Filed: Oct. 15, 1998

(86) PCT No.: PCT/US98/21832

§ 371 (c)(1),
(2), (4) Date: Jun. 26, 2000

(87) PCT Pub. No.: WO99/19943

PCT Pub. Date: Apr. 22, 1999

(51) Int. Cl.[7] ..... H01R 12/00
(52) U.S. Cl. ..... 439/63; 439/608
(58) Field of Search ..... 439/608, 101, 439/108, 63, 931, 675

(56) References Cited

U.S. PATENT DOCUMENTS

| | | | | |
|---|---|---|---|---|
| 3,401,369 A | | 9/1968 | Palmateer et al. | 339/17 |
| 3,587,028 A | | 6/1971 | Uberbacher | 339/14 |
| 4,571,014 A | | 2/1986 | Robin et al. | 339/14 |
| 4,605,269 A | | 8/1986 | Cohen et al. | 339/17 |
| 4,632,476 A | | 12/1986 | Schell | 339/14 |
| 4,720,770 A | | 1/1988 | Jameson | 361/387 |
| 4,749,368 A | | 6/1988 | Mouissie | 439/421 |
| 4,846,727 A | | 7/1989 | Glover et al. | 439/608 |
| 4,886,461 A | | 12/1989 | Smith | 439/67 |
| 4,898,546 A | | 2/1990 | Elco et al. | 439/608 |
| 4,975,066 A | | 12/1990 | Sucheski et al. | 439/63 |
| 4,984,992 A | | 1/1991 | Beamenderfer et al. | 439/108 |
| 5,163,835 A | | 11/1992 | Morlion et al. | 439/67 |
| 5,277,592 A | | 1/1994 | Morlion | 439/65 |
| 5,577,935 A | * | 11/1996 | Harting et al. | 439/581 |
| 5,620,340 A | | 4/1997 | Andrews | 439/608 |
| 5,741,144 A | * | 4/1998 | Elco et al. | 439/101 |
| 5,842,887 A | | 12/1998 | Andrews | 439/608 |
| 6,024,608 A | * | 2/2000 | Azuma et al. | 439/660 |
| 6,083,047 A | * | 7/2000 | Paagman | 439/608 |

FOREIGN PATENT DOCUMENTS

| | | |
|---|---|---|
| EP | 0 074 205 | 3/1983 |
| EP | 0 337 634 | 10/1989 |
| EP | 0 446 980 | 9/1991 |
| EP | 0 605 269 | 7/1994 |
| FR | 1 485 467 | 6/1967 |
| GB | 1 100 786 | 1/1968 |

* cited by examiner

*Primary Examiner*—Gary F. Paumen
(74) *Attorney, Agent, or Firm*—Woodcock Washburn LLP

(57) ABSTRACT

A high speed connector system includes a shielded header (10) and a receptable (30) with self shielded terminals.

35 Claims, 6 Drawing Sheets

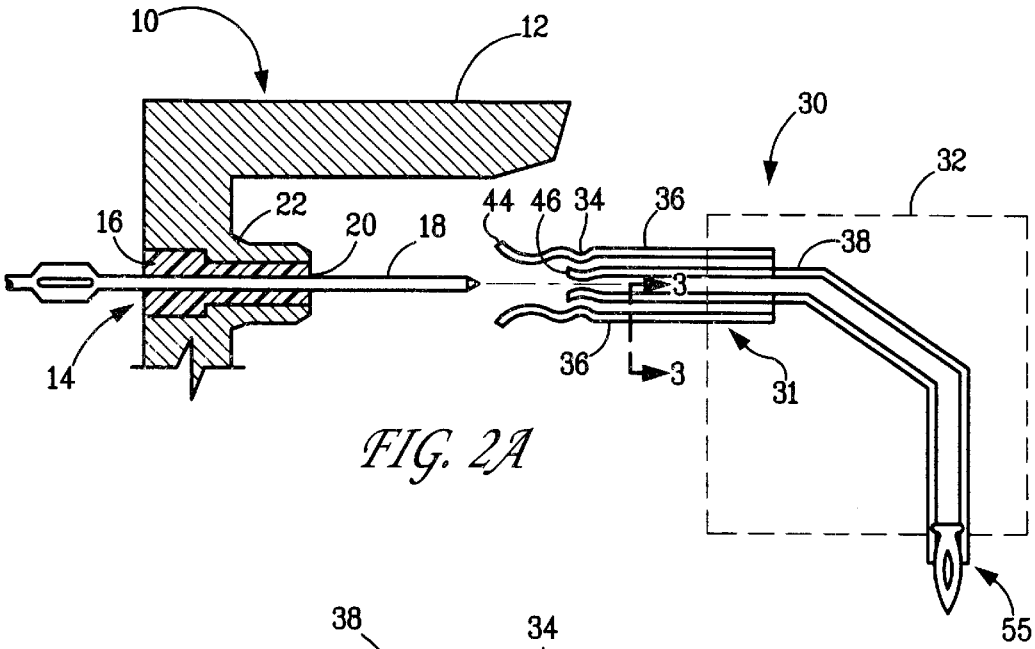
FIG. 2A
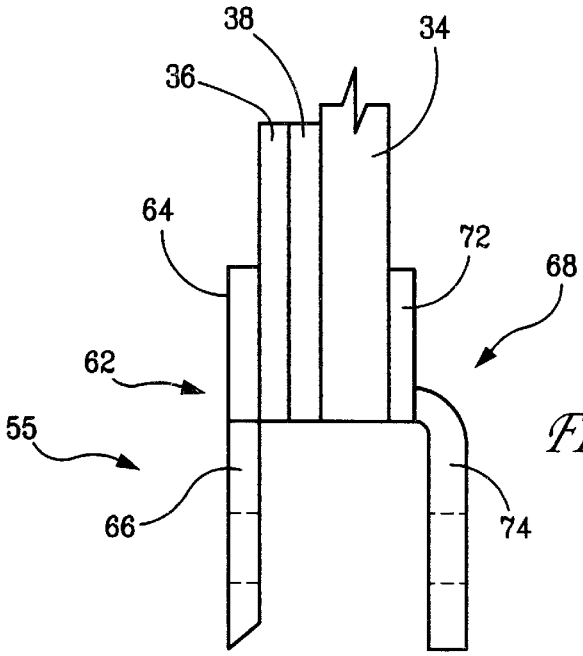
FIG. 2C
FIG. 3
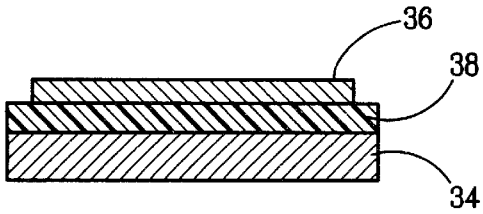

CONNECTOR SYSTEM

CROSS-REFERENCE TO RELATED APPLICATIONS

This application is the United States national phase of international Application No. PCT/US98/21832, filed on Oct. 15, 1998, which claims priority to U.S. application No. 08/950,454, filed Oct. 15, 1997.

FIELD OF THE INVENTION

The present invention relates in general to electrical connectors. More particularly, the present invention relates to electrical connectors having densely packed contact members capable of passing signals while minimizing crosstalk between adjacent contact members, especially at high frequencies.

BACKGROUND OF THE INVENTION

In electronic equipment, there is a need for electrical connectors providing connections in signal paths, and often the signal paths are so closely spaced that difficulties arise from interference between signals being transmitted along adjacent paths.

In order to minimize such difficulties it is known to provide grounding connections in such connectors, such connections serving in effect to filter out undesired interference between signal paths.

However, mere grounding is not always sufficient, and this is particularly so in connectors in which contacts constituting the signal paths through the connector extend through sharp angles, because interference between adjacent signal paths is a particularly significant problem in such connectors.

In many situations where electrical signals are being carried among separate subassemblies of complex electrical and electronic devices, reduced size contributes greatly to the usefulness or convenience of the devices or of certain portions of them. To that end, extremely small conductors are now available, and it is practical to manufacture very closely spaced terminal pads accurately located on circuit boards or the like. It is therefore desirable to have a connector of reduced size, to interconnect circuit boards repeatedly, easily, and reliably, and with a minimum adverse effect on electrical signal transmission in a circuit including such a connector.

In high speed backplane applications, low crosstalk between signal currents passing through the connector is desirable. Low crosstalk allows the electronics to switch at higher frequencies yet maintain signal integrity. Additionally, maximizing signal density is also desirable. High density increases the number of circuits that can be routed through the connector. However, as the density of devices and signals is increased, the problem of crosstalk increases. Moreover, as frequencies are increased, the crosstalk is increased.

Therefore, a need exists for electrical connectors of increased density, yet capable of maintaining signal integrity, especially at high frequencies. However, achieving these requirements must be in the context of smaller connectors that can be manufactured at low costs.

SUMMARY OF THE INVENTION

The present invention is directed to a connector for mounting to a circuit substrate comprising a housing and a connector pair supported by the housing. The connector pair includes a header connector having an electrically conductive connector housing, an opening in which an insulator element having a pin opening is disposed, a signal pin extending through the pin opening in the insulator element and through the connector housing and separated from the connector housing by the insulator element, and a raised ground surface adjacent the insulator element and the signal pin. The connector pair also includes a socket connector, having a signal receptacle contact, a ground receptacle contacts and a dielectric separating element separating the signal contact and the ground contact from one another, so that, in mated condition, the signal contact mechanically connects and electrically contacts with the signal pin, and the ground contact mechanically connects and electrically contacts with the raised cylindrical ground surface.

The present invention, is also directed to contact terminals formed of a base metallic layer capable of being shaped into a contact structure, a thin film dielectric material disposed on the base layer and a contact layer of conductive material disposed on the dielectric layer. The base layer may form a ground or shield structure and the conductive material may form the signal contact.

The present invention also concerns a socket connector comprising a receptacle housing and contact terminals in the housing. The signal receptacle contact is a dual cantilevered receptacle contact, and the ground receptacle contact is a dual cantilevered receptacle contact. The dual cantilevered ground contact is external to the dual cantilevered signal contact.

This invention further contemplates a socket connector having a contact terminal wherein the signal receptacle contact is a dual cantilevered signal contact, and the ground receptacle contact is a single cantilevered receptacle contact. The single cantilevered ground receptacle contact is offset 90 degrees to the dual cantilevered signal receptacle contact.

The foregoing and other aspects of the present invention will become apparent from the following detailed description of the invention when considered in conjunction with the accompanying drawing.

BRIEF DESCRIPTION OF THE DRAWINGS

FIG. 2A is a sectional side view of an exemplary connector in accordance with the present invention;

FIG. 2C is an end view of a mounting portion of terminals as shown in FIG. 2A FIG. 3 is a cross-sectional view of FIG. 2A taken along the line 3—3;

DESCRIPTION OF EXEMPLARY EMBODIMENTS AND BEST MODE

The present invention is directed to an electrical connector pair having a compact profile that provides coaxial-like electrical isolation of signal connections. The present invention provides signal isolation integrity within a contact engagement region in a minimized size profile.

Figure 1A:
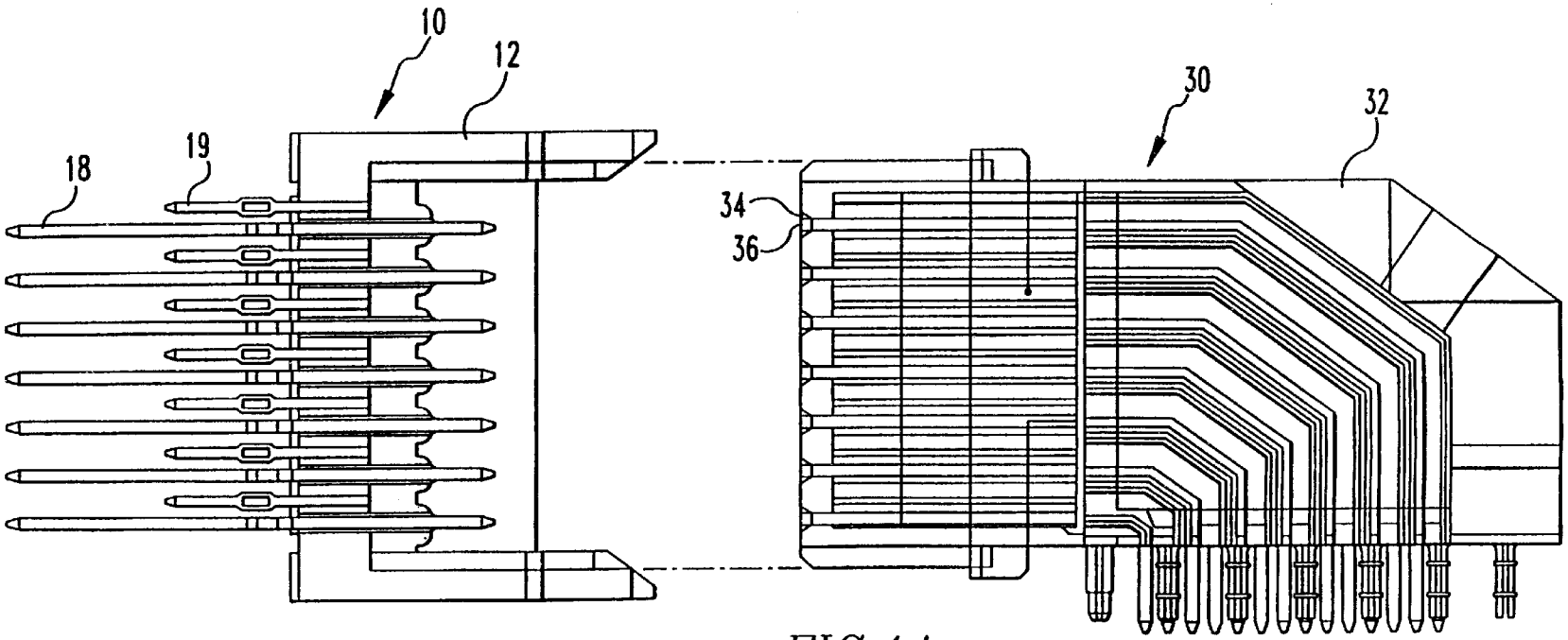
FIG. 1A is a sectional side elevational view of an embodiment of a high speed transmission connector, with the parts separated, according to the present invention.
Figure 1B:
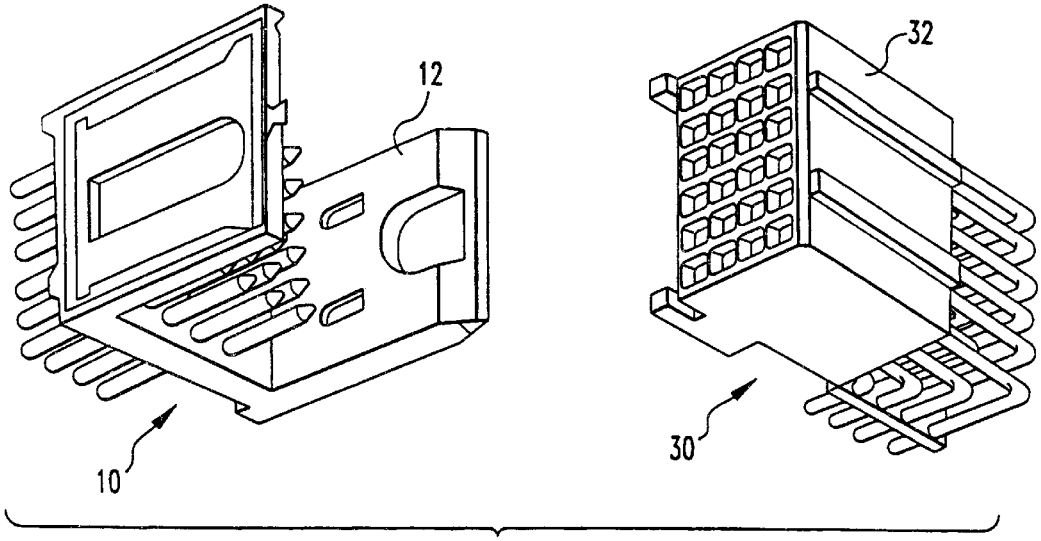
FIG. 1B is a perspective view of the connector of FIG. 1A, with the parts separated.

FIG. 1A is a sectional side elevational view of an embodiment of a high speed transmission connector, with the parts separated, according to the present invention. FIG. 1B is a perspective view of the connector of FIG. 1A, with the parts separated. A straight type of header connector 10 is comprised of a header housing 12 and pins (male contacts) 18 for a signal transmission line and pins (male contacts) 19 for a ground line. These pins 18 and 19 are alternately arranged in a plurality of rows on the header housing 12 of the associated connector 10. The pins are preferably stamped and formed with the preferred material being phosphor bronze or beryllium copper. The pins may also be formed of drawn wire. The header housing 12 is preferably formed of an electrically conductive material. The signal pins 18 are electrically insulated from the housing 12, as explained below. The ground pins 19 engage suitable ground connections in a motherboard. The header connector 10 can be mounted on or connected to a first printed circuit board, such as a motherboard or backplane.

A right angle type of socket connector 30 comprises a receptacle housing 32, ground receptacle contacts 34 for a ground line, and signal receptacle contacts 36 for a signal transmission line. A plurality of rows of the contacts 34 and 36 are regularly arranged so as to correspond to those formed by the pins 18 of the header connector 10. The socket connector 30 can be connected to or mounted on a second printed circuit board. The contacts are preferably stamped and formed as described below.

FIG. 2A shows a side view of an exemplary connector pair, comprising a header connector 10 and a socket connector 30, in accordance with the present invention. FIG. 2A contains elements similar to those described above with respect to FIG. 1A. These elements are labeled identically. The header connector 10 comprises a connector housing 12. The connector housing 12 is preferably electrically conductive and formed of metal, preferably a one piece metallic casting, such as, for example, a zinc or magnesium die casting. The connector 10 has an opening 14 with an insulating insert or bushing 16, preferably comprising an insulating dielectric. A signal pin 18 is inserted through a pin opening 20 in the insulator bushing 16 and extends through the housing 12 and insulator bushing 16. The insulator bushing 16 is used to insulate the signal pin 18 from the metallic connector housing 12. The casting 12 has a raised boss 22, preferably cylindrical, around the bushing 16. The outer surface of boss 22 acts as a coaxial ground connection.

A right angle type of socket connector 30 comprises a receptacle housing 32, schematically shown in FIG. 2A. A plurality of receptacle terminals, such as terminal 31, having a dual cantilevered beam ground receptacle contact layer 34, and a dual cantilevered beam signal receptacle contact layer 36 are secured by suitable means, such as an interference fit, into housing 32. Preferably, the ground receptacle contact layer 34 forms an outer contact, and the signal receptacle contact layer 36 forms an inner signal contact. A dielectric material 38, preferably a polymeric dielectric material such as a thin film polyimide, separates the ground contact layer 34 from the signal contact layer 36, as shown in FIG. 3. Each of the cantilevered contact layers 34, 36 of the socket connector 30 is provided, on the front end thereof, with a mating portion 44, 46 that can mate with ground connection 22 of the header connector 10 or the associated pin 18, respectively. Each of the terminals 31 can be provided, on the intermediate portion 50, with a right angle shape or a straight shape. Each of the terminals 31 is provided, on the securing or rear end portion 55 thereof, with suitable structure for electrically connecting contacts 34 and 36 with circuit traces on a printed circuit board. FIG. 2C shows one form of securing end portion 55. A terminal end element 62 for electrically associating signal layer 36 with a printed circuit includes a solder tab 64 and a terminal tail 66. The tab 64 is secured by soldering onto the signal layer 36. Similarly, a terminal end element 68 includes a solder tab 72, to be soldered onto shield layer 34. The terminal tails 66 and 74 can comprise a through hole tail, a pin-in-paste tail or a press fit tail. Alternatively, the terminal end elements 67 and 68 can include surface mount tails. The housing 32 is preferably molded, using a plastic material such as a high temperature thermoplastic.

The socket connector 30 can be connected to or mounted on a second printed card. By bringing the header connector 10 and the socket connector 30 together, the header connector 10 is mated with the socket connector 30. When mated, the outer receptacle contact formed of the ground contact layer 34 mates with the side surface of boss 22 and the inner receptacle contact formed of the signal contact layer 36 mates with the signal pin 18. In other words, the raised surface ground connection 22 engages the ground receptacle contact layer 34 to provide electrical isolation from other signal contacts that are within the connector pair in the contact engagement area. The socket terminal 31 is formed of a composite formed into self-sustaining cantilevered arms 33.

Figure 2B:
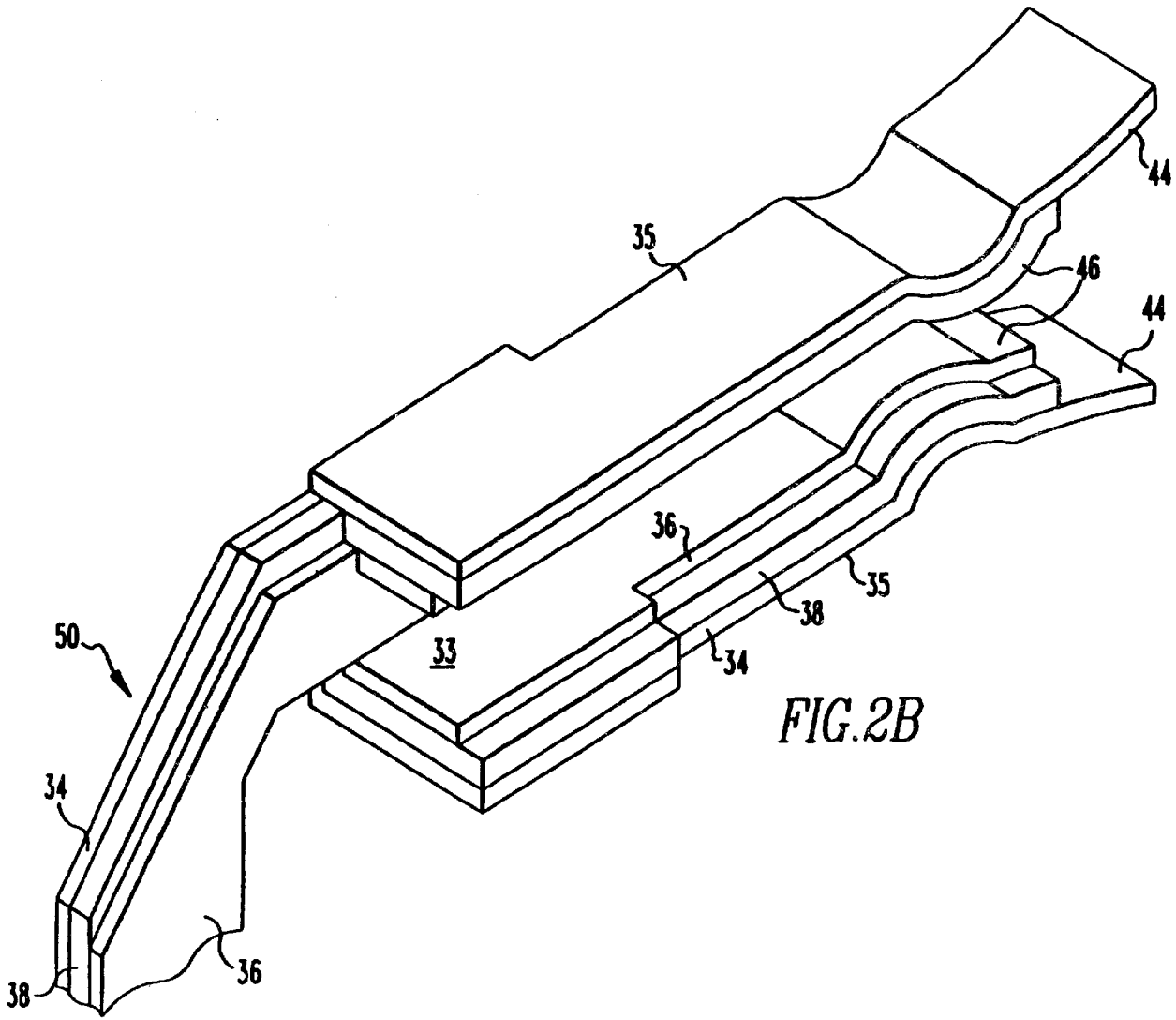
FIG. 2B is a perspective view of the socket connector of FIG. 2A.

FIG. 2B shows a perspective view of a preferred form of socket connector terminal 31. The terminal comprises dual beam arrangement having a U-shaped base portion 33. A pair of opposed cantilevered beams 35 extend from the opposed sections of the base portion 33. Ground or shield contact portions 44 and signal contact portions 46 are formed at the distal ends of beams 35. As shown, the ground receptacle contact layer 34 forms the outer contact, the signal receptacle contact layer 36 forms the inner contact, and the contact layers 34, 36 are separated by dielectric layer 38. Preferably the ground receptacle contact layer 34 comprises a metallic layer of a material capable of yielding mechanical and electrical properties suitable for electrical contacts. Phosphor bronze and beryllium copper alloys are suitable for this purpose. Layer 34 has a thickness in the range between approximately 8 and 15 mils, and a preferred thickness of between approximately 8 and 10 mils. This layer is form sustainable and provides the primary mechanical structural element of terminal 31. The dielectric layer 38 is preferably a polymeric dielectric material such as a thin film polyimide, which is applied or deposited in the form of an adherent sheet or layer on, and adheres to, the surface of the ground receptacle contact 34 to a thickness in the range between approximately 2 and 5 mils, and a preferred thickness of between approximately 2 and 4 mils. The signal receptacle contact 36 preferably comprises a copper layer, for example a rolled and annealed copper film, adhered on or deposited on the dielectric layer 38 and having a thickness in the range between approximately 2 and 6 mils, and a preferred thickness of between approximately 2 and 4 mils.

FIG. 3 shows a cross-section of this preferred composite construction. Thus the layers 36 and 38 may be disposed on selected portions of the layer 34, as desired. Once the composite formed of layers 34, 38 and 36 is assembled, the layers 36 and 38 may be patterned in desired configurations. This can be accomplished by known lithographic and etching techniques, or the layers 36 and 38 may be applied in a pre-patterned configuration onto base layer 34. The contacts can then be formed by stamping, bending, or otherwise forming the patterned composite structure comprising the layers 34, 36, 38. Alternatively, the metallic layers 34, 36 could be formed of conventional thickness contact materials.

Figure 4:
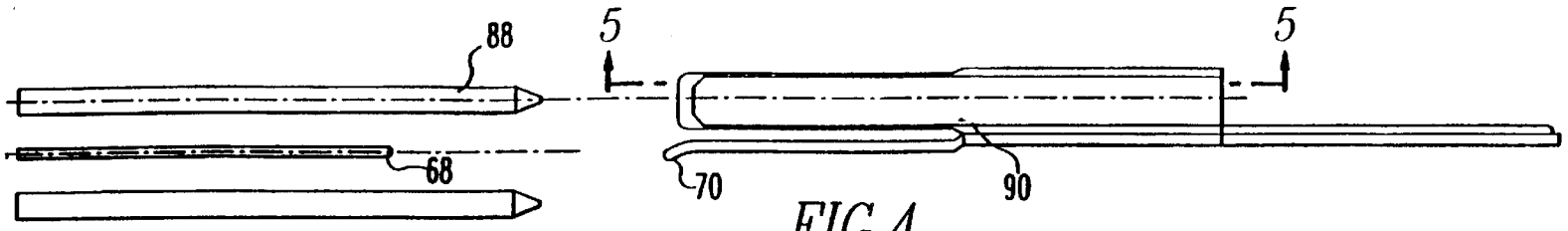
FIG. 4 is a side view of a further exemplary connector in accordance with the invention.

Another exemplary embodiment in accordance with the present invention is shown in FIG. 4. A single cantilever beam is used as the ground contact 70 and is offset 90 degrees from the signal contact 90. The signal contact 90 is preferably a dual beam contact that is substantially similar to the signal receptacle contact 46 of FIG. 2A, and makes electrical and mechanical contact with signal pin 88. The ground contact 70, when engaged with the header connector, makes electrical and mechanical contact with a ground surface, shown in FIG. 4 as element 68. In this embodiment element 68 comprises an intermediate shield. Such shields, when placed between columns of signal pins, electrically isolate columns of signal pins 88 from each other. Alternatively, ground contact 70 could be utilized to mate with boss 22 in the head embodiment of FIG. 1*a,* as explained below.

Figure 5:
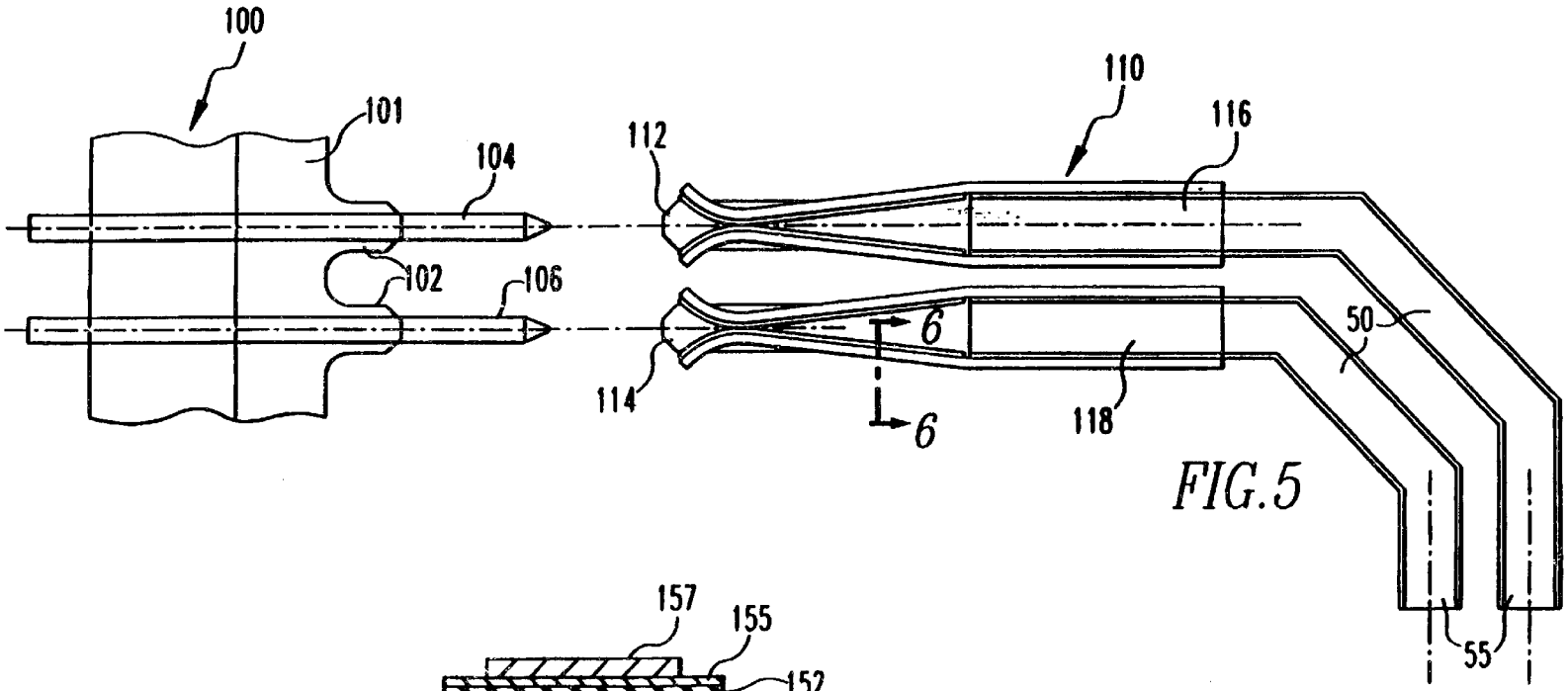
FIG. 5 is a view of the exemplary connector taken along the line 5—5 in FIG. 4.

A plurality of row and columns of the contacts of the connector pairs can be regularly arranged in a closely spaced array. FIG. 5 shows a plurality of signal pins 104, 106 inserted in a connector housing 101 that is within a header connector 100. Raised cylindrical surfaces 102 surround the signal pins 104, 106 and act as the ground connections. The signal pins 104, 106 and ground connections are substantially similar to the pins 18 and ground connections 22 in the header connector 10 of FIGS. 1 and 2. With respect to the socket connector side 110, single cantilever beams 112, 114 act as the ground receptacle contacts, as in the FIG. 4 embodiment, and are shown in the view of FIG. 5 as being alongside signal receptacle contacts 116, 118. The ground receptacle contacts are provided to engage the ground connections 102, and the signal receptacle contacts 116, 118 are provided to engage the signal pins 104, 106, respectively.

Figure 6:
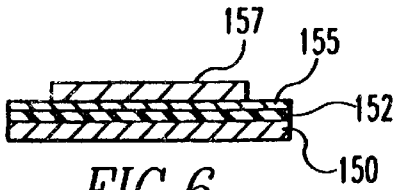
FIG. 6 is a cross-sectional view of FIG. 5 taken along the line 6—6.

FIG. 6 shows a cross-sectional view of FIG. 5 taken along the line 6—6. A base material 150 is used as a ground contact. Preferably the base material layer 150 corresponds and has the essentially same characteristics as previously described in connector with layer 34 in the embodiment of FIGS. 2*a* and 2*b*. A dielectric material 152, preferably a polymeric dielectric material such as a polyimide film, is applied or deposited in the form of an adherent sheet or layer on, and adheres to, the surface of the base material 150 to a thickness in the range between approximately 2 and 5 mils, and a preferred thickness of between approximately 2 and 4 mils. An adhesive 155 may be disposed on the surface of the dielectric material 152 to a preferred thickness of between approximately one-half and 1 mils. The adhesive is preferably acrylic or epoxy based and is applied in sheet form. A signal contact 157 is patterned and deposited on the adhesive 155. The signal contact layer corresponds to and has essentially the same characteristics as contact layer 36 of the FIGS. 2*a* and 2*b*. An advantage of this construction is that the layer 36 can be optimized for its conductivity because structural strength is provided by layer 34.

Figure 7:
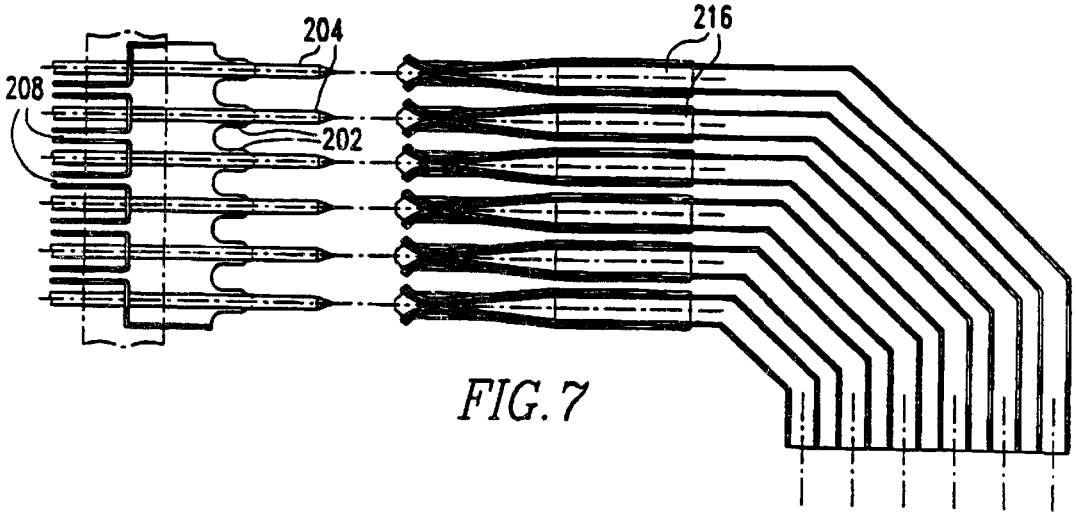
FIG. 7 shows a plurality of the connectors of FIG. 5 arranged in an array.
Figure 8:
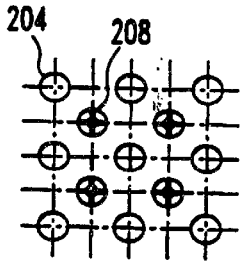
FIG. 8 shows an exemplary array pattern of the signal and ground pins.

FIG. 7 is similar to FIG. 5, and shows an array of six pairs of ground and signal receptacle contacts 216, six signal pins 204, and ground connections 202, preferably formed of raised cylindrical surfaces. The signal pins 204 and ground connections 202 are substantially similar to the pins 18 and ground connections 22 in the header connector 10 of FIGS. 1 and 2. The header has substantially the same coaxial arrangement at the base of the ground connections as in FIGS. 1 and 2. The preferable pitch is 2 mm, and preferably a signal contact column is interposed between two adjacently located ground contact columns. The ground connections 202 are coupled to ground pins 208. The signal pins 204 and the ground pins 208 are preferably spaced in an interstitial array as shown in FIG. 8 to provide increased density while minimizing crosstalk. Although the exemplary embodiment of FIG. 7 shows a column comprising six pairs of receptacle contacts and six signal pins, any number of contacts and pins can be used in an array of contacts and pins.

Figure 9:
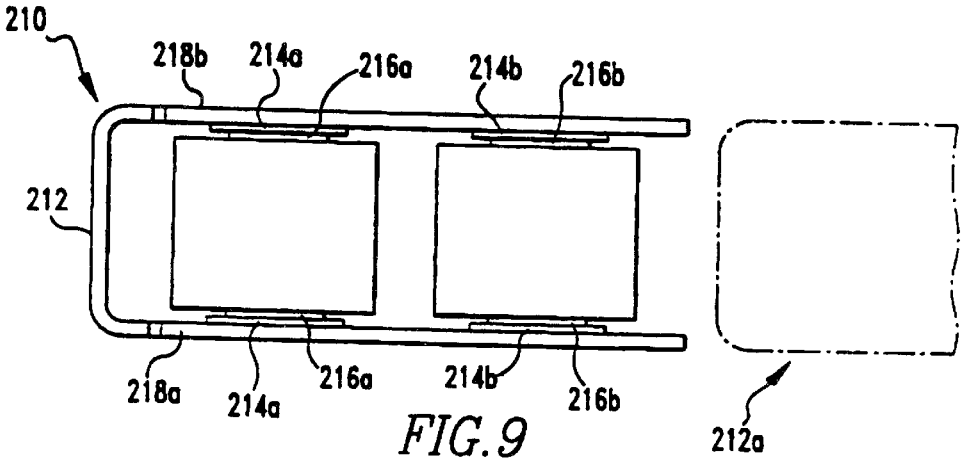
FIG. 9 shows a contact terminal structure for a system having differential pairs of signal carriers.

FIG. 9 illustrates a dual beam terminal 210 for a system employing differential pairs of signal carriers. In this embodiment the ground/structural layer 212 is formed of a suitable formable metallic material, for example phosphor bronze or beryllium copper as in previous embodiments. Dielectric layers 214 are formed by pre- or post patterning and are disposed on layer 212. Signal conductor layers 216*a* and 216*b* are disposed on dielectric layers 214. The terminal 210 is formed by stamping relative wide cantilevered arms 218*a* and 218*b* from layers 212 and bending layer 212 into a U-shape. In this form, the terminal 210 can accept a differential pair of signal pins 220 from a mating header. A pseudo-coaxial structure can result from the close proximity of an adjacent terminal 212*a*. The terminal 212 is formed in substantially the same form as discussed with respect to FIGS. 2*a,* 2*b,* 4 and 5 so that layer 212 is associated, by formation of a contact beam, with the ground structure in the mating header and is, stamped and shaped for form cantilever arms 218*a* and 218*b*.

It should be noted that although the socket connector of the illustrated embodiments is provided with right angle portion, the present invention is not limited thereto. For example, the present invention can be applied to a socket connector (not shown) having a straight type ground contact and a straight type signal contact, without a right angle portion.

Several advantages results from the structures described above. The ground layer is disposed close to the signal contacts providing enhanced shielding. Further, the ground and signal elements can be formed simultaneously in the same structure, thereby reducing manufacturing costs by reducing the number of forming and assembly steps. A high conductivity material can be used to form the signal contact layer, with lesser regard of its mechanical strength properties.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed is:

1. An intermating pair of connectors comprising:

a header connector having an electrically conductive connector housing, an opening in which an insulator element having a pin opening is disposed, a signal pin extending through the pin opening in said insulator element and through said connector housing and separated from said connector housing by said insulator element, and a raised ground surface disposed adjacent said signal pin; and a socket connector, having a socket terminal comprising at least two signal receptacle contact layers, a ground receptacle contact layer, and a dielectric layer separating at least one of said signal contact layer and said ground contact layer from one another, so that, in mated condition, said signal pin extends between the at least two signal receptacle layers and forms an electrical connection therebetween, and said ground contact electrically contacts with said raised ground surface.

2. The connector of claim 1, wherein the socket terminal comprises a composite structure formed by said ground receptacle contact layer, dielectric layer and signal contact layer.

3. The connector of claim 1, wherein said header connector housing is constructed from a one piece metallic casting.

4. The connector of claim 1, wherein said socket connector further comprises a receptacle housing, and wherein said signal receptacle contact is a dual cantilevered beam signal receptacle contact, and said ground receptacle contact is a dual cantilevered beam ground receptacle contact.

5. The connector of claim 4, wherein said dual cantilevered beam ground receptacle contact is external to said dual cantilevered beam signal receptacle contact.

6. The connector of claim 4, wherein each of the cantilevered signal contacts of the socket connector is provided, on the distal end thereof, with a portion matable with an associated pin of said header connector.

7. The connector of claim 1, wherein said signal receptacle contact is a dual cantilevered beam signal receptacle contact, and said ground receptacle contact is a single cantilevered beam ground receptacle contact.

8. The connector of claim 7, wherein said single cantilevered beam ground receptacle contact is offset about 90 degrees with respect to said dual cantilevered beam signal receptacle contact.

9. The connector of claim 7, wherein each of the cantilevered contacts of the socket connector is provided, on the front end thereof, with a portion that is matable with the associated pin of said header connector.

10. The connector of claim 1, wherein said raised surface ground surface surrounds a portion of said signal pin.

11. The connector of claim 1, wherein said ground receptacle contact layer comprises a shape sustaining layer.

12. The connector of claim 1, wherein said signal receptacle contact layer comprises a thin film.

13. The connector of claim 12, wherein the thickness of said film is in the range between about 2 and about 4 mils.

14. The connector of claim 1, wherein said dielectric separating element comprises a thin film.

15. The connector of claim 1, wherein said raised surface is an integral boss. that forms a coaxial shield around a portion of said signal pin.

16. The connector of claim 15, wherein said portion of said signal pin is the base of said signal pin.

17. A connector pair comprising:

a header connector having a header housing, a signal pin extending through a pin opening in said header housing, and a ground surface adjacent said signal pin; and a socket connector having a receptacle housing, a terminal in the receptacle housing, said terminal having at least two signal receptacle contact layers, a ground receptacle contact layer, and a dielectric layer interposed between at least one of said signal contact and said ground contact, so that, in mated condition, said signal pin extends between the at least two signal receptacle layers and forms an electrical connection therebetween, and said ground contact electrically contacts with said ground surface.

18. The connector pair of claim 17, wherein the socket terminal comprises a composite structure formed by said ground receptacle contact layer dielectric layer, said signal contact layer, and said dielectric layer.

19. The connector pair of claim 17, wherein said connector housing is constructed from a one piece metallic casting.

20. The connector pair of claim 17, wherein said signal receptacle contact is a dual cantilevered beam signal receptacle contact, and said ground receptacle contact is a dual cantilevered beam ground receptacle contact.

21. The connector pair of claim 20, wherein said dual cantilevered beam ground receptacle contact is external to said dual cantilevered beam signal receptacle contact.

22. The connector pair of claim 20, wherein each of the cantilevered contacts of the socket connector is provided, on a distal end thereof, with a portion that is matable with the associated pin of said header connector.

23. The connector pair of claim 17, wherein said signal receptacle contact is a dual cantilevered beam signal receptacle contact, and said ground receptacle contact is a single cantilevered beam ground receptacle contact.

24. The connector pair of claim 23, wherein said single cantilevered beam ground receptacle contact is offset about 90 degrees with respect to said dual cantilevered beam signal receptacle contact.

25. The connector pair of claim 24, wherein each of the cantilevered contacts of the socket connector is provided, on the front end thereof, with a portion that can mate with the associated pin or ground connection.

26. The connector pair of claim 17, wherein said ground surface surrounds a portion of said pin.

27. The connector pair of claim 17, wherein said signal receptacle contact layer comprises a thin film.

28. The connector pair of claim 27, wherein the thickness of said film is in the range between about 2 and about 4 mils.

29. The connector pair of claim 17, wherein said dielectric separating element comprises a thin film.

30. The connector pair of claim 26, wherein said ground surface comprises an integral boss that forms a coaxial shield around a portion of said signal pin.

31. The connector pair of claim 30, wherein said portion of said signal pin is the base of said signal pin.

32. An electrical connector, comprising:

an insulative housing; and a plurality of terminal structures, each structure formed as a laminate of:

a first conductive layer for engaging a signal contact on a mating connector;

a second conductive layer for engaging a ground contact on the mating connector; and a dielectric layer between said first and second conductive layers;

wherein said structure is arranged so that said second conductive layer at least partially surrounds said first conductive layer, and said plurality of structures are arranged so that said second conductive layers form a pseudo-coaxial arrangement around said first conductive layers.

33. A terminal structure comprising:

a first contact layer comprising a signal contact layer formed into a dual beam receptacle contact;

a second contact layer; and an insulating layer disposed between and adjacent to said first and second contact layer to join and electrically separate said first and second contact layers.

34. The terminal structure of claim 33, wherein the second contact layer comprises a shielding contact layer formed into a shielding contact; the shielding contact further comprising a beam disposed offset about 90 degrees with respect to said dual cantilevered beam receptacle contact.

35. A terminal structure comprising:

a first contact layer;

a second contact layer comprising a shielding contact layer formed into a shielding contact, the shielding contact further comprising a dual beam contact external to the signal contact layer; and an insulating layer disposed between and adjacent to said first and second contact layer to join and electrically separate said first and second contact layers.

* * * * *